United States Patent [19]

Nakagawa

[11] 4,177,960

[45] Dec. 11, 1979

[54] AUTOMATIC PAPER SPLICING CONTROL DEVICE

[75] Inventor: Hiroshi Nakagawa, Yokohama, Japan

[73] Assignee: Tokyo Kikai Seisakusho Ltd., Tokyo, Japan

[21] Appl. No.: 857,136

[22] Filed: Dec. 5, 1977

[30] Foreign Application Priority Data

Dec. 30, 1976 [JP] Japan ..... 51-159250

[51] Int. Cl.[2] ..... B65H 19/14; B32B 31/00; B65H 19/08

[52] U.S. Cl. ..... 242/58.3; 156/358; 156/504

[58] Field of Search ..... 156/350, 358, 504; 242/58.1, 58.3, 58.2

[56] References Cited

U.S. PATENT DOCUMENTS

| | | | |
|---|---|---|---|
| 2,621,865 | 12/1952 | Wieking | 242/58.3 |
| 3,042,332 | 7/1962 | Astley | 242/58.3 |
| 3,223,339 | 12/1965 | Justus et al. | 242/58.3 |
| 4,077,580 | 3/1978 | Lang et al. | 242/58.3 |

*Primary Examiner*—Douglas J. Drummond

[57] ABSTRACT

An automatic paper splicing control device including a depressing means for depressing a travelling paper onto a roll paper the surface to be joined thereby by means of an adhesive coated on the roll paper. A time T being required to contact the travelling paper with the roll paper. A pulse generating device generates pulse signals having a frequency proportional to the number of revolutions of the roll paper. A detector detects the adhesive coated surface arriving at a predetermined position. A counter counts the number of pulses generated by the pulse generating means. The control device modifies the time of starting of the depressing means in accordance with the number of pulses counted by the counter during the time T to thereby accommodate changes in the diameter size of the roll paper and its surface speed.

5 Claims, 4 Drawing Figures

AUTOMATIC PAPER SPLICING CONTROL DEVICE

BACKGROUND OF THE INVENTION

1. Field of the Invention

This invention relates generally to an automatic paper splicing control device, and more specifically to an automatic paper splicing control device for automatically splicing a travelling paper with a roll paper while the papers continuously travel. The travelling paper is spliced with the roll paper in a good condition by controlling the splice so that the travelling paper is in contact with the surface of the roll paper when the adhesive coated area of the roll paper surface reaches a predetermined position.

2. Description of the Prior Art

In a rotary press, for example, a roll is prepared in advance so that a part of its surface is coated with adhesive. The roll paper is then spliced with a travelling paper immediately before the travelling paper is used up, thus enabling the printing paper to be fed continuously. As shown in FIG. 1, a roll paper 2 has part of its surface coated with adhesive. The roll paper is disposed at a predetermined position with respect to a travelling paper 1 running in the direction as shown by arror a. The roll paper is rotated in the direction b so that the surface of the roll paper 2 maintains approximately the same speed as the travelling speed of the travelling paper 1. Immediately before the travelling paper 1 is used up, the travelling paper 1 is depressed onto the surface of the roll paper by operating a depressing means such as the brush 4, to cause the roll paper to be spliced with the travelling paper 1 by means of the adhesive 3. At that moment, a cutter 5 is operated to cut the travelling paper 1 at a predetermined position following the spliced portion of the travelling paper 1 and the roll paper 2.

In this type of paper splicing device, the brush 4 comes in contact with the travelling paper 1 to depress the travelling paper 1 onto the roll paper just at the moment when the adhesive coated area of the roll paper 2 arrives at the position to be spliced. At that moment, however, the travelling paper 1 tends to slip off the adhesive coated area, resulting in a splicing failure.

Taking this drawback into consideration, a device has been devised in which control is effected so that the travelling paper 1 is depressed onto the roll paper by means of the brush 4 at a time To, before the adhesive coated area arrives at the position to be spliced. The travelling paper 1 and the roll paper 2 are then spliced with each other by the brush 4 which has already arrived at the position to be spliced even before the adhesive coated area arrives at the position to be spliced. That is, assume that the time for the brush 4 to move to the position to be spliced is T. A detecting means for detecting the leading edge of the adhesive 3 is disposed at a predetermined angular position at which the leading edge of the adhesive 3 can be detected at time (T+To) before the adhesive 3 arrives at the position to be spliced. When the detecting means detects the adhesive 3, the detecting means issues a command for starting the operation. However, the proper splicing may not be effected in this type of paper splicing control device partly because the diameter of the roll paper 2 is not constant, and partly because the surface speed of the roll paper 2 varies with the individual type of roll paper.

SUMMARY OF THE INVENTION

An object of this invention is to provide an automatic paper splicing control device which solves the above-mentioned problems.

Another object of this invention is to provide an automatic paper splicing control device which is capable of properly splicing a roll paper with a travelling paper, regardless of the position of the roll paper, and utilizing a detecting means which is disposed at a fixed position at all times.

Still another object of this invention is to provide an automatic paper splicing control means which is capable of properly splicing a roll paper with a travelling paper even when the surface speed of the roll paper unwantedly varies.

DETAILED DESCRIPTION OF THE PREFERRED EMBODIMENTS

Figure 1:
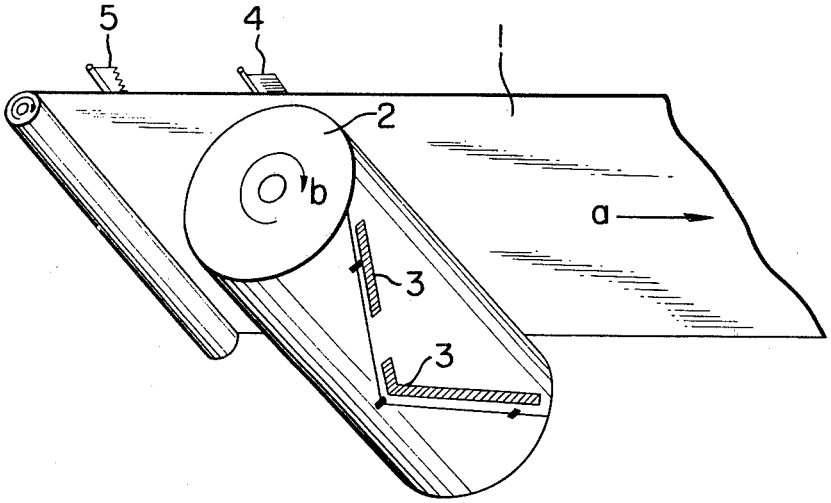
FIG. 1 is a perspective view illustrating a paper splicing device.
Figure 2:
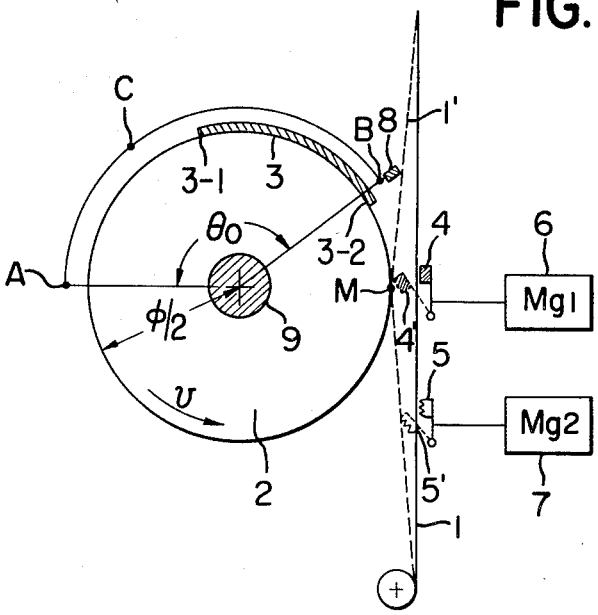
FIG. 2 is a schematical representation illustrating this invention.

In FIG. 2, numerals 1, 2, 3, 4 and 5 correspond with like numerals in FIG. 1. Numeral 1' refers to a travelling paper which has been depressed by the brush 4. Numeral 4' refers to the brush when it is in the connecting position M, and is actuated to depress onto the roll paper 2. Numeral 5' refers to the cutter 5 acuated to cut the travelling paper 1. Numeral 6 is an electromagnet Mg1 which drives the brush 4. Numeral 7 is an electromagnet Mg2 which drives the cutter 5. Numeral 8 is a detecting means disposed at a predetermined position with respect to the roll paper 2 for detecting the leading edge 3-1 of the adhesive 3. Numeral 9 is a pulse generating means for outputting pulse signals having a frequency proportional to the number of revolutions of the roll paper 2.

Assuming that the time required for the brush 4 to cause the travelling paper 1 to contact the roll paper 2 by the action of the electromagnet 6, is T; the surface speed of the roll paper 2 is v; the diameter of the roll paper 2 is $\phi$, and the number of pulse signals generated by the pulse generating means 9 during a full turn of the roll paper 2 is P. Then, the number of revolutions per unit time N of the roll paper is expressed by $$N=v/\pi\cdot\phi \tag{1}$$

and the rotating angle $\theta$ of the roll paper is expressed by $$\theta=N\times T=v\cdot T/\pi\cdot\phi \tag{2}$$

Therefore, the number of pulse signals $P_T$ produced by the pulse generating means 9 is expressed by $$P_T=\theta\times P=v\cdot T\cdot P/\pi\cdot\phi \tag{3}$$

As is evident from equation (3), the number of pulse signals $P_T$ produced in time T is proportional to the surface speed v of the roll paper and is inverse to the diameter $\phi$ of the roll paper. Therefore, when a piece of roll paper 2 whose diameter $\phi$ is smallest and whose surface speed is highest among other pieces of roll paper is spliced with the travelling paper 1, the number pulse signals $P_T$ becomes maximum. Thus $P_T$ (max) is expressed by $$P_T(\max)=v(\max)\cdot T\cdot P/\pi\cdot\phi(\min) \quad (4)$$

In this invention, the position of the detecting means 8 is set based on the maximum number of generated pulses $P_T(\max)$ as expressed by equation (4). That is, if contact between the travelling paper 1 and the roll paper 2 is to be started at the time when the leading edge 3-1 of the adhesive 3 reaches a point opposite point A as shown in FIG. 2, then the detecting means 8 is disposed at a position B which is shifted from the point A by an angle $\theta_0$ equal to the maximum number of generated pulses $P_T(\max)$ in the direction opposite to the rotation of the roll paper 2. When the detecting means 8 detects the leading edge 3-1 of the adhesive 3, an exciting current is fed to the electromagnet 6. In such an arrangement however, if the diameter $\phi$ or the surface speed v of the roll paper 2 varies, then the revolution of the roll paper 2 corresponding to the travelling speed of the travelling paper is changed. Assuming that the surface speed v of the roll paper 2 is constant, then the revolution of the roll paper 2 decreases when the diameter $\phi$ of the roll paper 2 increases larger than $\phi$ min described above. Assuming that the diameter of the roll paper 2 is $\phi'$ and its surface speed is v', then the rotating angle $\theta'$ of the roll paper 2 during the above mentioned time T is expressed by $$\theta'=v'\cdot T/\pi\cdot\phi' \quad (2)',$$

and the number of pulse signals $P_T'$ generated by the pulse generating means 9 in the time T is expressed by $$P_T'=\theta'\times P=v'\cdot T\cdot P/\pi\cdot\phi \quad (3)'$$

That is, exciting current is to be fed to the electromagnet 6 when the leading edge 3-1 of the adhesive 3 reaches a point C in FIG. 2.

For this reason, according to this invention, exciting current is fed to the electromagnet 6 only after waiting for an interval of time starting from when detecting means 8 at the point B detects leading edge 3-1, until the leading edge 3-1 of the adhesive 3 reaches the point C.

The time required for the leading edge 3-1 to move from the point B to the point C corresponds with $$P_T(\max)-P_T'$$

in terms of the number of pulse signals.

Therefore, the number of pulse signals $P_T'$ which is generated by the pulse generating means 9 during the time T before the leading edge 3-1 reaches the point B is measured and stored in a register, which will be described later in connection with FIG. 3. After the leading edge 3-1 reaches the position B, the number of pulse signals generated by the pulse generating means 9 is added to the contents of the register, and when the number of pulses reaches a point satisfying $$P_T'+K=P_T(\max),$$

exciting current is fed to the electromagnet 6. In other words, when the number of pulse signals $K=P_T(\max)-P_T'$ is measured, exciting current is fed to the electromagnet 6.

Figures 3, 4:
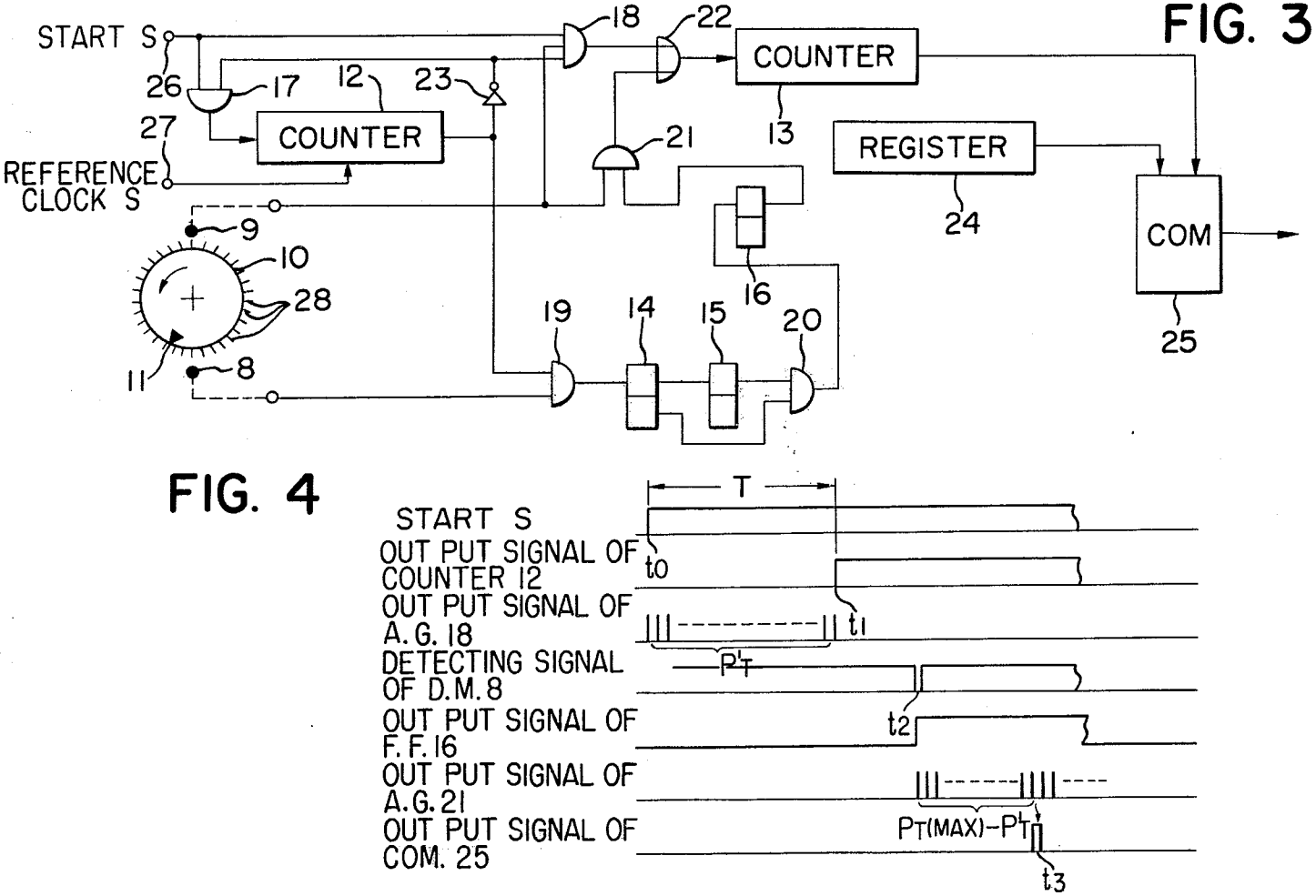
FIG. 3 is a block diagram of an automatic paper splicing control device embodying this invention.
FIG. 4 is a time chart for aiding in explaining the operation of the device embodying this invention.

FIG. 3 shows an embodiment of this invention. In the figure, the numeral 8 refers to a detecting means, for example an electromagnetic pulse generator which is disposed at the point B shown in FIG. 2 and generates a detecting signal by temporarily turning off its output when a metal piece 11, which will be described later, reaches a position opposite it. Numeral 9 refers to a pulse generating means, for example an electromagnetic pulse generator which generates pulse signals every time the projections 28 of a metal gear 10 passes by. Numeral 10 is a metal gear mounted on a rotating shaft of the roll paper 2. Numeral 11 is a metal piece provided at a position corresponding to the position of the leading edge 3-1 of the adhesive 3. Numerals 12 and 13 refers to counters, and numerals 14, 15, and 16 refer to flip-flop circuits. Numerals 17 through 21 refer to AND gates, while numeral 22 is an OR gate, and numeral 23 is a NOT gate. Numeral 24 refers to a register in which the maximum number of generated pulses $P_T(\max)$ mentioned above is stored in advance. Numeral 25 is a comparator circuit for comparing the contents of the counter 13 and the contents of the register 24. Numeral 26 is an input terminal to which start signals are applied. Numeral 27 is an input terminal to which reference clock signals are applied. Numeral 28 are the projections of the metal gear 10. The circuit operation will now be described while referring to the time chart of FIG. 4.

Start signals are applied to the input terminal 26 at a point of time $t_0$ with the roll paper 2 rotating at a constant speed. The metal gear 10 rotates at the same constant speed. AND gate 17 is turned on and the counter 12 starts counting the reference clock signals. On the other hand, as the start signals are applied, the AND gate 18 permits the pulse signals from the pulse generating means 9 to pass and the counter 13 starts counting the pulse signals via the OR gate 22. At a point of time when the counter 12 finishes counting reference clock signals up to a predetermined number, or at a point of time $t_1$ as shown in FIG. 4, the counter 12 starts outputting logic "1" signals, as shown in FIG. 4. Consequently, the output signal of the NOT gate 23 becomes a logic "0" at the point of time $t_1$, turning off the NOT gate 18.

In other words, the counter 13 finishes counting at the point of time $t_1$. In this case, the time from $t_0$ to $t_1$ is set to be equal to the time T described in FIG. 2.

Therefore, the contents of the counter 13 at the point of time $t_1$ represent the number of pulse signals generated by the pulse generating means 9 during the time from $t_0$ to $t_1$, or the number of pulses $P_T'$ described above in FIG. 2.

Subsequently, when the detecting means 8 produces a detecting signal by temporarily turning off its output as the metal piece 11 reaches a point opposite to the detecting means 8 at a point of time $t_2$ as shown in FIG. 4, the AND gate 19 which has been in the ON state is turned off, resetting the flip-flop circuit 14. Thus, the output of the AND gate 20 which receives the output of the flip-flop circuit 15, which in turn had been in the ON state, becomes a logic "1", setting the flip-flop circuit 16. The set output signal of the flip-flop circuit 16 becomes a logic "1" from the point of time $t_2$, as shown in FIG. 4. As a result, from time $t_2$ the AND gate 21 permits the pulses from pulse generating means 9 to pass and the counter 13 starts counting the above mentioned pulse signals via the OR gate 22. That is, the counter 13 sequentially adds pulse signals inputted via the AND gate 21 and the OR gate 22 to the number of pulses $P_T'$ generated during the time from $t_0$ to $t_1$, as described above. When at time $t_3$ the contents of the counter 13 becomes equal to the contents of the register 24, or the maximum number of generated pulses $P_T(max)$, a coincidence signal is outputted from the comparator circuit 25 to drive the brush 4. After the coincidence signal is outputted, all the contents of the counters 12 and 13, and the flip-flop circuits 14 through 16 are cleared.

As described above, this invention makes it possible to cause the roll paper and the travelling paper to contact, regardless of the difference in the diameter and surface speed of the roll paper, when the leading edge of the adhesive reaches a predetermined position. This eliminates the need to change the detecting part on the adhesive for roll papers of different diameter, thereby leading to improved operating efficiency.

What is claimed is:

1. An automatic paper splicing control device for splicing the adhesive portion of a rotating roll paper with a travelling paper, comprising a depressing means for depressing the travelling paper against the roll paper and onto the part thereof having the adhesive and requiring a time T from its start of operation for causing the travelling paper to contact with the roll paper, pulse generating means for generating pulse signals having a frequency proportional to the revolutions of the roll paper, detecting means for detecting a predetermined position of the adhesive, counting means for counting the number of pulses generated by the pulse generating means during a time T and prior to the start of operation, and control means for modifying the time of occurrence of the start of operation of the depressing means in accordance with the contents counted by the counter during the time T, said detecting means being disposed at a position angularly separated from the position where the roll paper and travelling paper are spliced and in a direction opposite to the rotation of the roll paper, said angular separation corresponding to a maximum number of pulses generated during a time T by a roll paper of minimum diameter and maximum speed which is to be used, whereby the start of operation is delayed from said detecting means position.

2. An automatic paper splicing control device set forth in claim 1 wherein the counting means counts the number of pulses generated by the pulse generating means during the time T and to sequentially add thereto the number of pulses generated by the pulse generating means from the time the detecting means detects said predetermined position, and wherein said control means comprises register means for storing a count corresponding to a predetermined timing interval and a comparator circuit means for comparing the contents of the counter means and the contents of the register means and producing a coincidence signal, said depressing means starting its operation in response to said coincidence signal.

3. An automatic paper splicing control device set forth in claim 2 wherein the count stored in said register means corresponds to said maximum number of pulses.

4. An automatic paper splicing control device set forth in claim 1 and further comprising a metal gear having projections on its periphery fixedly retained on the rotating shaft of the roll paper, and wherein said pulse generating means comprises an electromagnetic pulse generator for generating pulse signals as the projections of the metal gear pass by it.

5. An automatic paper splicing control device set forth in claim 1 and further comprising a metal piece provided on the surface of the roll paper for indicating said predetermined position of the adhesive, and wherein said detecting means comprises an electromagnetic pulse generator generating a detecting signal as the metal piece passes by it.

* * * * *